US008428479B2

(12) United States Patent
Asaoka et al.

(10) Patent No.: US 8,428,479 B2
(45) Date of Patent: Apr. 23, 2013

(54) IMAGING DEVICE AND IMAGE FORMING APPARATUS

(75) Inventors: Akira Asaoka, Kanagawa (JP); Atsushi Sampe, Kanagawa (JP); Toshiya Satoh, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 327 days.

(21) Appl. No.: 12/805,987

(22) Filed: Aug. 27, 2010

(65) Prior Publication Data

US 2011/0064433 A1 Mar. 17, 2011

(30) Foreign Application Priority Data

Sep. 14, 2009 (JP) ..... 2009-211356

(51) Int. Cl.
*G03G 15/00* (2006.01)
*G03G 21/00* (2006.01)

(52) U.S. Cl.
USPC ..... 399/46; 399/346

(58) Field of Classification Search ..... 399/46, 399/346, 353
See application file for complete search history.

(56) References Cited

U.S. PATENT DOCUMENTS

2006/0210334 A1* 9/2006 Tokumasu et al. ..... 399/346
2007/0122217 A1 5/2007 Nagashima et al.
2009/0185842 A1* 7/2009 Hatori et al. ..... 399/346
2010/0129113 A1 5/2010 Sampe et al.

FOREIGN PATENT DOCUMENTS

JP 2008-096518 4/2008

OTHER PUBLICATIONS

Machine translation of reference Kikuchi (JP Pub No. 2008-096518 A), Listed in IDS. Pub date Apr. 24, 2008.*

* cited by examiner

*Primary Examiner* — Walter L Lindsay, Jr.
*Assistant Examiner* — Rodney Bonnette
(74) *Attorney, Agent, or Firm* — Harness, Dickey & Pierce, P.L.C.

(57) ABSTRACT

An imaging device includes an image carrying member; a developing unit for forming a toner image by developing an electrostatic latent image that has been formed on the image carrying member in a charged state; a cleaning unit for cleaning a toner that remains on the image carrying member after the toner image has been transferred from the image carrying member onto a transfer material; a lubricant applying unit for applying a lubricant on the image carrying member; and a control unit for performing drive control of the image carrying member, the developing unit, the cleaning unit, and the lubricant applying unit. Before the imaging device starts an imaging operation, the control unit controls the image carrying member, the developing unit, and the cleaning unit to perform respective operations; while controls the lubricant applying unit to repeat performing and suspending the operation in an intermittent manner.

4 Claims, 2 Drawing Sheets

FIG. 3
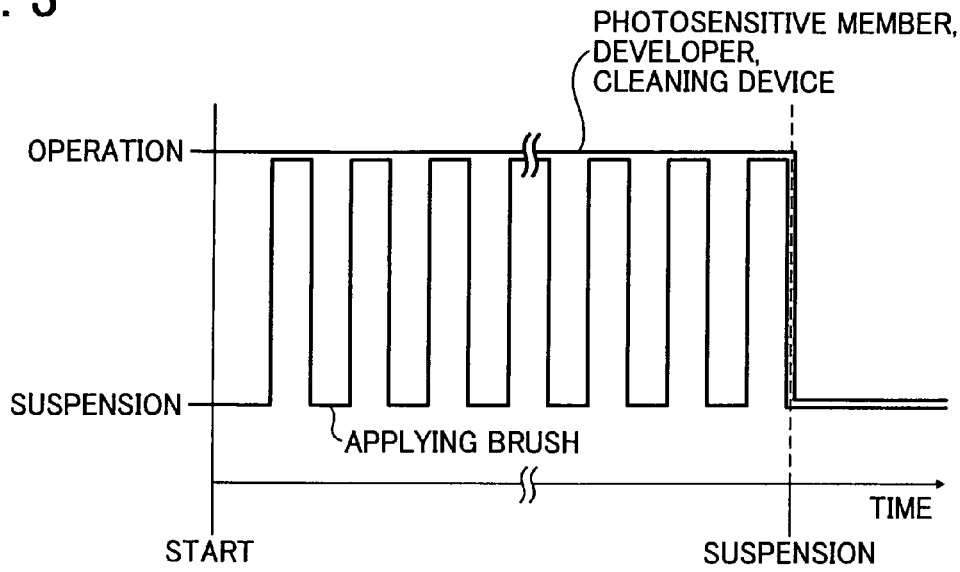
FIG. 4
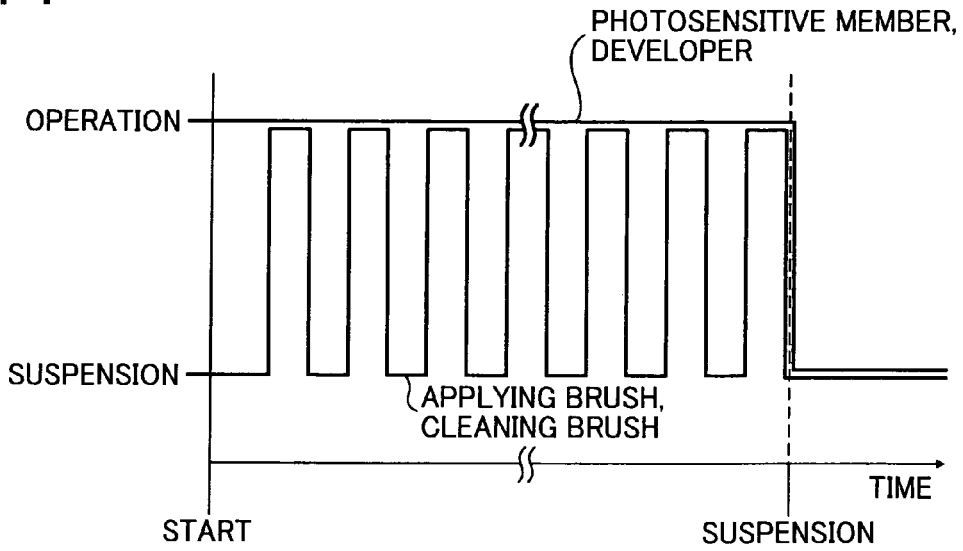
FIG. 5
| IDLE OPERATION MODE | BLURRED IMAGES |
|---|---|
| PRESENT | NOT FORMED |
| ABSENT | FORMED |

IMAGING DEVICE AND IMAGE FORMING APPARATUS

CROSS-REFERENCE TO RELATED APPLICATIONS

The present application claims priority to and incorporates by reference the entire contents of Japanese Patent Application No. 2009-211356 filed in Japan on Sep. 14, 2009.

BACKGROUND OF THE INVENTION

1. Field of the Invention

The present invention relates to an imaging device and an image forming apparatus of electrophotographic type, and particularly relates to an imaging device including a charging unit and a lubricant applying unit for applying a lubricant on an image carrying member and relates to an image forming apparatus including that imaging device.

2. Description of the Related Art

In imaging devices used in electrophotographic image forming apparatuses, it is known that the discharge produced by a charging unit leads to the generation of discharge products such as ozone or nitrogen oxide (NOx). Besides, with regard to recent image forming apparatuses, the demand for large-quantity printing has been on the rise. In order to meet that demand, development of high-speed image forming apparatuses is well underway. With the aim of achieving a high speed, charging chargers that are compatible to high speed processing are being preferred over charging rollers. However, the use of such charging chargers leads to an increase in the generated quantity of discharge products.

In image forming apparatuses including a charging charger, an air duct is disposed to form an airstream path through which the discharge products generated from the charging charger are removed from the vicinity thereof. Moreover, an ozone filter is disposed at the duct outlet so that the discharge products are filtered before being let to pass to the outside of the image forming apparatus.

Hence, usually, the discharge products do not remain inside the image forming apparatus. However, if problems such as clogging of the ozone filter, decline in the room ventilation capacity, or deterioration of the charging charger lead to the generation of a large quantity of discharge products that exceeds the filtering capacity of the ozone filter, then it becomes difficult to sufficiently evacuate the discharge products. Thus, sometimes the discharge products remain in the vicinity of the charging charger. If an image forming job is performed when the discharge products remain attached to the image carrying member, then electrostatic latent images get distorted and the image development also gets affected. As a result, the output images become blurred (hereinafter, "blurred images").

To address such an issue, Japanese Patent Application Laid-open No. 2008-96518 discloses a technology as follows: upon completion of an image forming job, a post-image-formation lubricant applying mode is implemented in which a photosensitive body functioning as the image carrying member is rotated and a lubricant applying device is operated in such a way that a thicker adhering layer of lubricant is formed on the photosensitive member after the image forming job is complete. Hence, even if the discharge products are attached to the photosensitive member, they can be removed along with the adhering layer of lubricant by a cleaning unit prior to the start of the subsequent image forming job. Such measures prevent the formation of blurred images.

However, in a configuration in which an adhering layer of lubricant is formed on a photosensitive drum as disclosed in Japanese Patent Application Laid-open No. 2008-96518, the adhering layer of lubricant undergoes deterioration if the image forming apparatus is left unattended for a long period of time such as during the night-time. In such a case, the adhering layer of lubricant having the discharge products adsorbed therein gets so firmly attached to the photosensitive member that the cleaning unit cannot easily remove the adhering layer of lubricant prior to the start of the subsequent image forming job. That makes it harder to perform correction of blurred images. In order to eliminate the blurred images, an idle operation mode such as the post-image-formation lubricant applying mode needs to be implemented for a plurality of times prior to the start of the subsequent image forming job.

SUMMARY OF THE INVENTION

It is an object of the present invention to at least partially solve the problems in the conventional technology.

According to an aspect of the present invention, there is provided an imaging device including: an image carrying member; a developing unit for forming a toner image by developing an electrostatic latent image that has been formed on the image carrying member in a charged state; a cleaning unit for cleaning a toner that remains on the image carrying member after the toner image has been transferred from the image carrying member onto a transfer material; a lubricant applying unit for applying a lubricant on the image carrying member; and a control unit for performing drive control of the image carrying member, the developing unit, the cleaning unit, and the lubricant applying unit, wherein before the imaging device starts an imaging operation, the control unit controls the image carrying member, the developing unit, and the cleaning unit to perform respective operations, while controls the lubricant applying unit to repeat performing and suspending the operation in an intermittent manner.

According to another aspect of the present invention, there is provided an image forming apparatus comprising the imaging device mentioned above.

The above and other objects, features, advantages and technical and industrial significance of this invention will be better understood by reading the following detailed description of presently preferred embodiments of the invention, when considered in connection with the accompanying drawings.

BRIEF DESCRIPTION OF THE DRAWINGS

FIG. 3 is a timing chart for explaining exemplary operations of an applying brush in an idle operation mode according to the present embodiment;

FIG. 4 is a timing chart for explaining exemplary operations of the applying brush in another idle operation mode according to the present embodiment; and FIG. 5 is a table of a confirmatory result of the effect when an idle operation mode according to the present embodiment is implemented and when no idle operation mode is implemented.

DETAILED DESCRIPTION OF THE PREFERRED EMBODIMENTS

Figure 1:
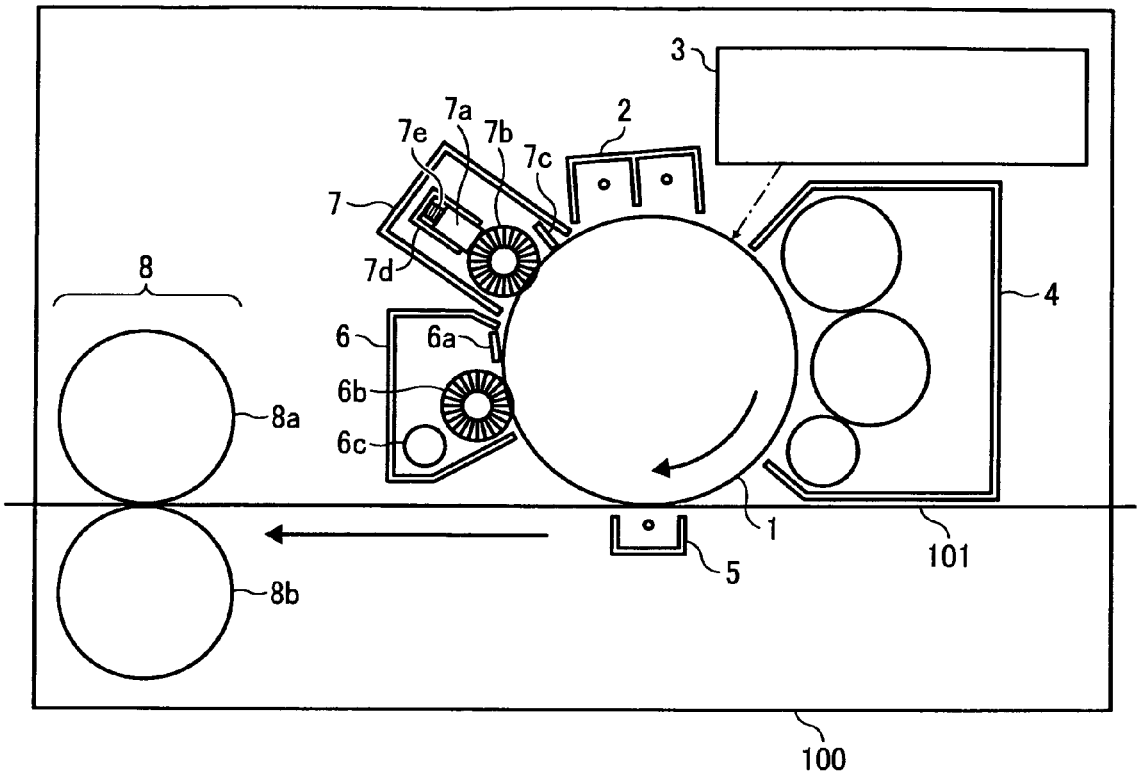
FIG. 1 is a cross-sectional view of an exemplary outline configuration of an imaging device according to an embodiment of the present invention.

In order to achieve the object of the present invention, an image forming apparatus includes an imaging device as described below. In the present invention, the imaging device includes an image carrying member; a developing unit for forming a toner image by developing an electrostatic latent image that has been formed on the image carrying member in a charged state; a cleaning unit for cleaning the residual toner on the image carrying member after the toner image has been transferred from the image carrying member onto a transfer material; a lubricant applying unit for applying a lubricant on the image carrying member; and a control unit for performing the drive control of the image carrying member, the developing unit, the cleaning unit, and the lubricant applying unit. Before the imaging device starts an imaging operation, the control unit controls the image carrying member, the developing unit, and the cleaning unit to perform respective operations so as to control the lubricant applying unit to repeat performing and suspending the operation in an intermittent manner.

Such a configuration enables easy removal of the discharge products that get attached to the image carrying member while the image forming apparatus is left unattended. As a result, formation of blurred images can be easily prevented.

Moreover, in the present invention, the lubricant applying unit in the imaging device includes at least one applying brush for applying a lubricant on the image carrying member. The control unit makes the applying brush perform the operation in an intermittent manner. In the present embodiment, by making the applying brush perform the operation in an intermittent manner, a smaller quantity of the lubricant gets applied on the top of the lubricant that has the discharge products adsorbed therein and that has already adhered to the photosensitive member. That enables the cleaning unit to easily remove the lubricant that has the discharge products adsorbed therein and that has already adhered to the photosensitive member. As a result, it is the fresh lubricant that always gets applied on the photosensitive member.

Besides, in the present invention, the cleaning unit in the imaging device includes at least one cleaning brush for cleaning the image carrying member. The control unit makes the cleaning brush perform the operation in an intermittent manner and in synchronization with the intermittent operations of the applying brush. In the present embodiment, the operation of the cleaning brush is stopped so that it becomes possible to accumulate the toner in between the cleaning brush and the photosensitive member. Since the toner enables the cleaning unit to efficiently scrape off the surface of the photosensitive member, the lubricant having the discharge products adsorbed therein can be efficiently removed from the surface of the photosensitive member. Because of such a configuration, it is possible to efficiently reduce the quantity of the lubricant applied due to the intermittent operations of the applying brush and to remove the lubricant having the discharge products adsorbed therein.

According to the present invention, in the imaging device, both of the applying brush of the lubricant applying unit and the cleaning brush of the cleaning unit are driven by the same driving source. Thus, the applying brush and the cleaning brush can be operated in synchronization using a simple configuration and with a simple control.

Meanwhile, in the present invention, the imaging device is configured to be a detachable process cartridge in which the lubricant applying unit, the image carrying member, and at least one of the charging unit, the developing unit, and the cleaning unit are integratedly disposed.

Given below is the description of an image forming apparatus according to an embodiment of the present invention. The image forming apparatus according to the present embodiment includes an imaging device 100, a paper tray (not illustrated) for housing sheets of paper as the transfer material, a conveying device (not illustrated) for conveying the paper sheets from the paper tray, and a discharge unit (not illustrated) for discharging the paper sheets on which images have been printed to the outside of the image forming apparatus.

In the following description, the photosensitive member is assumed to be a photosensitive drum having a drum-like shape. Alternatively, for example, it is also possible to use a photosensitive belt having a belt-like shape as the photosensitive member. Besides, the following description is given for a single-color image forming apparatus including a single image carrying member. However, the description is also applicable to, for example, a multicolor image forming apparatus including a plurality of image carrying members.

Figure 2:
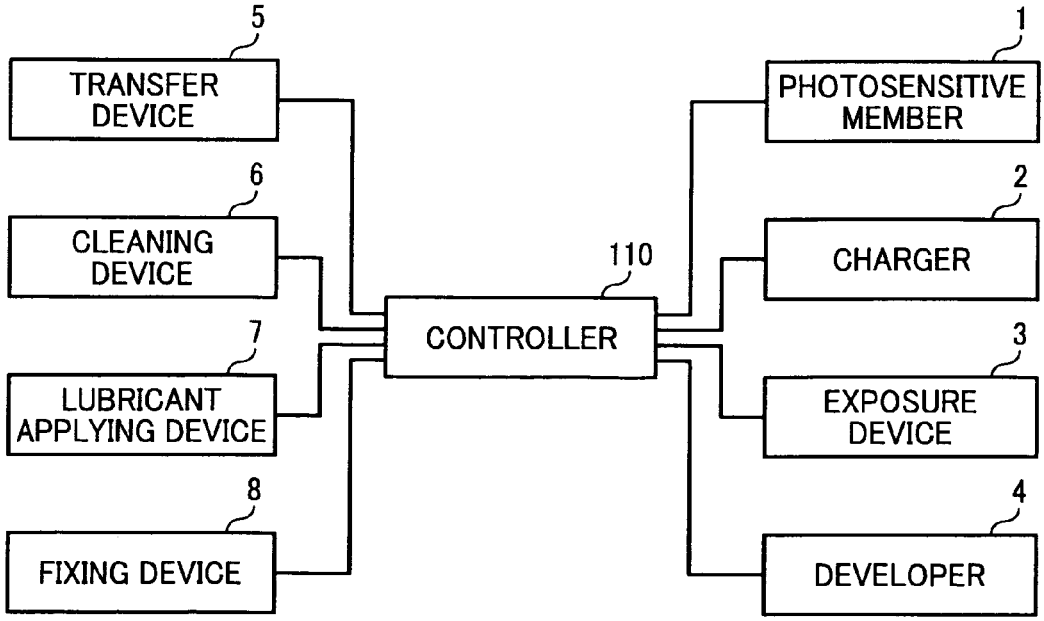
FIG. 2 is a block diagram of an exemplary configuration of a control system in the imaging device according to the present embodiment.

FIG. 1 is a cross-sectional view of an exemplary outline configuration of the imaging device according to the present embodiment. FIG. 2 is a block diagram of an exemplary configuration of a control system in the imaging device according to the present embodiment. The imaging device 100 includes a photosensitive member 1 as the image carrying member, a charger 2 as the charging unit, an exposure device 3, a developer 4 as the developing unit, a transfer device 5, a cleaning device 6 as the cleaning unit, a lubricant applying device 7 as the lubricant applying unit, and a fixing device 8. Each of these constituent elements is connected to and drive-controlled by a controller 110 as the control unit while performing operations described below. The controller 110 is a microcomputer including a central processing unit (CPU), a read only memory (ROM), and a random access memory (RAM) and is put into practice by executing software.

The photosensitive member 1 starts rotating by an image-forming-operation start signal sent by the controller 110. Moreover, the photosensitive member 1 rotates at a speed equivalent to the printing speed of the image forming apparatus and continues to rotate until the image forming operation is complete. Once the photosensitive member 1 starts rotating, a high voltage is applied to the charger 2 so that the surface of the photosensitive member 1 is uniformly charged to, for example, a negative charge.

When text data or graphic data that has been converted into dot image is sent as an ON/OFF signal of the exposure device 3 by the controller 110 to the image forming apparatus, the surface of the photosensitive member 1 is divided into a portion illuminated by a laser light radiated from the exposure device 3 and a portion not illuminated by the laser light. That results in the formation of an electrostatic latent image on the surface of the photosensitive member 1. Consider the portion on the photosensitive member 1 from which the charge disappears due to the exposure to the laser light emitted from the exposure device 3. When that portion reaches the position opposite to the developer 4, the negatively-charged toner gets adsorbed due to the static electrical charge so that a toner image is formed on the photosensitive member 1.

Due to the operation of the transfer device 5 by which a charge of opposite polarity to the polarity of the toner image formed on the photosensitive member 1 is applied to a paper sheet 101, the toner image gets adsorbed on the paper sheet 101. The portion of the photosensitive member 1 that passes by the transfer device 5 is then cleaned by the cleaning device 6 and the residual toner on the photosensitive member 1 is collected in a collecting unit (not illustrated). To the cleaned portion of the photosensitive member 1 that has passed by the cleaning device 6, the lubricant applying device 7 applies a lubricant with an aim of enhancing the cleaning capability of the cleaning device 6 as well as protecting the photosensitive member 1. In this way, the photosensitive member 1 gets ready for the subsequent image forming operation.

Subsequently, the paper sheet 101 is conveyed to the fixing device 8, in which a pair of fixing rollers 8*a* and 8*b* form a nip portion. At least one of the fixing rollers 8*a* and 8*b* is a heating roller. The paper sheet 101 passes through the nip portion and is subjected to pressure so that the toner image is fixed by melting on the paper sheet 101.

Herein, it is assumed that the charger 2 implements corona charging using corotron. Alternatively, the charger can implement corona charging using scorotron with a grid, can implement contact-type roller charging, or can implement non contact-type roller charging.

The cleaning device 6 according to the present embodiment includes a cleaning blade 6*a* and a cleaning brush 6*b*. During an image forming operation, the cleaning brush 6*b* rotates and the cleaning blade 6*a* abuts against the photosensitive member 1. Because of that, the residual toner on the photosensitive member 1 gets cleaned. The residual toner is then conveyed to a collection conveying roller 6*c* and collected in the collecting unit (not illustrated).

The lubricant applying device 7 includes a solid lubricant 7*a*, an applying brush 7*b* for scraping off the solid lubricant 7*a* and for applying it on the photosensitive member 1, and an applying blade 7*c* for evening out the lubricant applied on the photosensitive member. Moreover, the solid lubricant 7*a* is housed in a substantially cubical case 7*d* and is pressed by a spring 7*e* so that the solid lubricant 7*a* abuts against the applying brush 7*b* with a predetermined pressure. As an alternative to the spring 7*e*, it is also possible to make use of the weight of a weight body as the pressing force.

Meanwhile, the solid lubricant 7*a* can be manufactured from a fatty acid metal salt lubricant such as zinc stearate, lead oleate, zinc oleate, copper oleate, cobalt stearate, ferric stearate, copper stearate, zinc palmitate, or zinc linolenate.

Meanwhile, the imaging device 100 can be configured to be a process cartridge that is detachable as a unit from the image forming apparatus and in which the lubricant applying device 7, the photosensitive member 1, and at least one of the charger 2, the developer 4, and the cleaning device 6 are integratedly disposed.

In the imaging device 100, discharge products such as ozone or nitrogen oxide (NOx) are generated from the charger 2. In the present example, since the charger 2 implements corona charging, the discharge products are generated in large quantity. Hence, in the image forming apparatus, an air duct (not illustrated) is disposed to form an airstream path through which the discharge products are removed from the vicinity of the charger 2. Moreover, an ozone filter (not illustrated) is disposed at the duct outlet so that the discharge products are filtered before being let to pass to the outside of the image forming apparatus.

However, even in such a configuration, if problems such as clogging of the ozone filter, decline in the room ventilation capacity, or deterioration of the charger 2 lead to the generation of a large quantity of discharge products that exceeds the filtering capacity of the ozone filter, then there are times when it is difficult to sufficiently evacuate the discharge products. Thus, sometimes the discharge products remain in the vicinity of the charger 2. If an image forming job is performed when the discharge products remain attached to the photosensitive member 1, then the electrostatic latent images formed by the exposure device 3 get distorted and the image development performed by the developer 4 also gets affected. As a result, blurred images are output.

In the configuration in which the lubricant applying device 7 applies a lubricant on the photosensitive member 1, the abovementioned problem worsens if the image forming apparatus is left unattended for a long period of time such as during the night-time. In that case, the lubricant applied on the photosensitive member 1 deteriorates and, in a condition in which the discharge products remain adsorbed therein, adheres to the photosensitive member 1.

To address that issue, in the present embodiment, before an imaging operation is performed, the controller 110 makes the photosensitive member 1, the developer 4, and the cleaning device 6 perform respective operations, as well as implements an idle operation mode in which the lubricant applying device 7 is made to periodically repeat performing and suspending the operation at regular intervals. Herein, the controller 110 performs driving and stopping of a driving motor for the photosensitive member 1, the developer 4, and the cleaning device 6 at predetermined timings.

FIG. 3 is a timing chart for explaining exemplary operations of the applying brush in the idle operation mode. In the present example, in the idle operation mode; the photosensitive member 1, the developer 4, and the cleaning device 6 perform operations without a break. On the other hand, the applying brush 7*b* of the lubricant applying device 7 repeats performing operations and stopping at regular intervals. Herein, it is not necessary that the operating time of the applying brush 7*b* is identical to the downtime thereof. For example, the applying brush 7*b* can perform operations in an intermittent manner with an operating time of 10 seconds and the downtime of 3 seconds.

In the absence of the control performed in the present example, if the applying brush 7*b* operates without a break, then a new layer of the lubricant gets applied on the top of the lubricant that has the discharge products adsorbed therein and that has already adhered to the photosensitive member 1. As a result, the lubricant quantity exceeds the lubricant removing capacity of the cleaning device 6. Thus, it either takes a long time to remove the lubricant that has the discharged products adsorbed therein and that has already adhered to the photosensitive member 1 or it becomes difficult to completely remove that lubricant.

In contrast, as described in the present embodiment, by making the applying brush 7*b* repeat performing and suspending the operation, it becomes possible to reduce the quantity of the lubricant getting applied on the top of the lubricant that has the discharge products adsorbed therein and that has already adhered to the photosensitive member 1. That enables the cleaning device 6 to easily remove the lubricant that has the discharge products adsorbed therein and that has already adhered to the photosensitive member 1. Hence, it is the fresh lubricant that always gets applied on the photosensitive member 1.

Besides, by making the developer 4 to perform the operation, the toner gets attached to the photosensitive member 1. Since the toner enables the cleaning device 6 to efficiently scrape off the surface of the photosensitive member 1, it contributes in the efficient removal of the lubricant from the photosensitive member 1.

Meanwhile, the controller 110 can also implement another idle operation mode. FIG. 4 is a timing chart for explaining exemplary operations of the applying brush in another idle operation mode. In this example, the cleaning brush 6*b* of the cleaning device 6 is controlled to repeat performing and suspending the operation in synchronization with the applying brush 7*b*.

As described above, the toner enables the cleaning device 6 to efficiently scrape off the surface of the photosensitive member 1. This, by stopping the operations of the cleaning brush 6*b*, the toner accumulates in between the cleaning brush and the photosensitive member and further contributes in scraping off the surface of the photosensitive member 1. In this case, the applying brush 7*b* and the cleaning brush 6*b* can be driven by the same driving source (not illustrated). Thus, the applying brush 7*b* and the cleaning brush 6*b* can be operated in synchronization using a simple configuration and with a simple control.

Such idle operation modes prove effective when implemented prior to the start of an image forming operation to be performed after a period during which the image forming apparatus was left unattended. For example, an idle operation mode can be implemented upon completion of an image forming operation which the image forming apparatus is to be left unattended. Alternatively, an idle operation mode can be implemented immediately prior to the start of an image forming operation to be performed after a period during which the image forming apparatus was left unattended.

Given below is the description of an experiment carried out for comparing between an image forming apparatus having an idle operation mode and an image forming apparatus without an idle operation mode. FIG. 5 is a table of a confirmatory result of the effect when an idle operation mode according to the present embodiment is implemented and when no idle operation mode is implemented. For this comparison, 1000 A4-sized pages were printed before leaving the image forming apparatuses unattended. Then, for the case when an idle operation mode was implemented and the case when no idle operation mode was implemented, it was determined whether blurred images were formed in the subsequent image forming operation.

Herein, each image forming apparatus used for the experiment included the lubricant applying device 7. Besides, the implemented idle operation mode was the mode in which the applying brush 7*b* and the cleaning brush 6*b* perform operations in an intermittent manner.

As illustrated in FIG. 5, the absence of the idle operation mode resulted in the formation of blurred images, while the implementation of the idle operation mode could prevent the formation of blurred images. That confirmed the effect of the idle operation mode.

Thus, according to an aspect of the present invention, the discharge products that get attached to the image carrying member while the image forming apparatus is left unattended can be easily removed. As a result, formation of blurred images can be easily prevented.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An imaging device comprising:

an image carrying member;

a developing unit for forming a toner image by developing an electrostatic latent image that has been formed on the image carrying member in a charged state;

a cleaning unit for cleaning a toner that remains on the image carrying member after the toner image has been transferred from the image carrying member onto a transfer material, the cleaning unit includes at least one cleaning brush for cleaning the image carrying member;

a lubricant applying unit for applying a lubricant on the image carrying member, the lubricant applying unit including at least one applying brush for applying a lubricant onto the image carrying member; and a control unit for performing drive control of the image carrying member, the developing unit, the cleaning unit, and the lubricant applying unit, wherein before the imaging device starts an imaging operation, the control unit controls the image carrying member and the developing unit to perform respective operations, controls the lubricant applying unit and the cleaning unit to repeat performing and suspending the operation in an intermittent manner and controls the at least one cleaning brush and the at least one applying brush to perform operations in synchronization.

2. The imaging device according to claim 1, wherein the applying brush of the lubricant applying unit and the cleaning brush of the cleaning unit are driven by a single driving source.

3. The imaging device according to claim 1, wherein the imaging device is configured to be a detachable process cartridge in which the lubricant applying unit, the image carrying member, and at least one of the charging unit, the developing unit, and the cleaning unit are integratedly disposed.

4. An image forming apparatus comprising the imaging device according to claim 1.

* * * * *